US008288651B2

(12) United States Patent
Smith

(10) Patent No.: US 8,288,651 B2
(45) **Date of Patent: *Oct. 16, 2012**

(54) WEATHERPROOF CONNECTOR

(76) Inventor: Kenneth Smith, Seattle, WA (US)

( * ) Notice: Subject to any disclaimer, the term of this patent is extended or adjusted under 35 U.S.C. 154(b) by 804 days.

This patent is subject to a terminal disclaimer.

(21) Appl. No.: 12/271,560

(22) Filed: Nov. 14, 2008

(65) Prior Publication Data

US 2009/0088010 A1 Apr. 2, 2009

Related U.S. Application Data

(63) Continuation-in-part of application No. 11/864,314, filed on Sep. 28, 2007, now Pat. No. 7,554,034.

(51) Int. Cl.
*H01H 9/02* (2006.01)

(52) U.S. Cl. ..... 174/53; 174/54; 174/66; 174/57; 174/135; 439/490; 439/137; 220/296

(58) Field of Classification Search ..... 174/66, 174/67, 53, 57, 54, 135; 439/137, 142, 135, 439/358, 357, 490, 489, 910, 136, 271; 220/296, 220/241, 242

See application file for complete search history.

(56) References Cited

U.S. PATENT DOCUMENTS

| | | | | |
|---|---|---|---|---|
| 3,915,476 | A * | 10/1975 | Burkle | 439/34 |
| 4,138,187 | A * | 2/1979 | Brygger | 439/142 |
| 5,030,120 | A * | 7/1991 | Hartley | 174/67 |
| 5,545,046 | A * | 8/1996 | Masuda et al. | 439/142 |
| 5,709,561 | A * | 1/1998 | Cadoret et al. | 439/144 |
| 6,745,911 | B1 * | 6/2004 | Maestranzi | 439/34 |
| 7,554,034 | B2 * | 6/2009 | Smith | 174/66 |
| 7,575,450 | B2 * | 8/2009 | Williams et al. | 439/144 |
| 7,758,360 | B2 * | 7/2010 | Lesage et al. | 439/135 |

* cited by examiner

*Primary Examiner* — Angel R Estrada
(74) *Attorney, Agent, or Firm* — Robert A Jensen; Jensen & Puntigam, P.S.

(57) ABSTRACT

A weatherproof power inlet box and mating plug wherein the inlet box and mating plug are asymmetrical, positively latched and include more robust elements and a visual indicator of the status of the interconnect. Also included is a thermostat that trips to prevent overheating.

5 Claims, 8 Drawing Sheets

WEATHERPROOF CONNECTOR

This application is a continuation-in-part of U.S. application Ser. No. 11/864,314.

TECHNICAL FIELD

This invention relates to a weatherproof connector and more particularly to a weatherproof connector system, wherein the electrical connector elements prevent misconnections and, when properly connected, interlock to prevent accidental disconnect, and visually indicate the status of the connection. Also incorporated is a thermostat to break connection in the unlikely event of overheating.

BACKGROUND OF THE INVENTION

Electrical interconnects have been available and are used principally to supply power to camping vehicles or motor homes when parked and boats when at dock. The standard electrical interconnect includes projecting prongs which must be aligned with the appropriate receptacle as well as including a bayonet type securement device to prevent inadvertent dislodge of the interconnect. These known devices have been known to malfunction because of the continuous motion as on a boat, thereby causing overheating and a resulting fire. Examples of known interconnects are shown in U.S. Pat. No. 5,118,301, granted to Bentivolio Jun. 2, 1992, which serves as an interconnect between matched female connector devices.

U.S. Pat. No. 5,984,719, granted to Flegel Nov. 16, 1999, discloses an auxiliary power supply system but also discloses a standard electrical interconnect.

Likewise, U.S. Pat. No. 6,163,449 granted to Flegel Dec. 19, 2000, utilizes a standard electric interconnect.

DISCLOSURE OF THE INVENTION

With the above-noted prior art in mind, an electric interconnect is provided wherein the mating of the two parts is predetermined by the pre-file configuration of the mating parts, thereby preventing any inadvertent incorrect interconnect.

Further the inventive device includes not only a more robust interconnect element, but also a failsafe securement method in addition to superior sealing from the weather.

The inventive device includes a superior cover and LEDs to indicate the status of the interconnect, i.e., polarity and/or power presence.

It also includes a thermostat to guard against overheating.

BEST MODE FOR CARRYING OUT THE INVENTION

Figure 1:
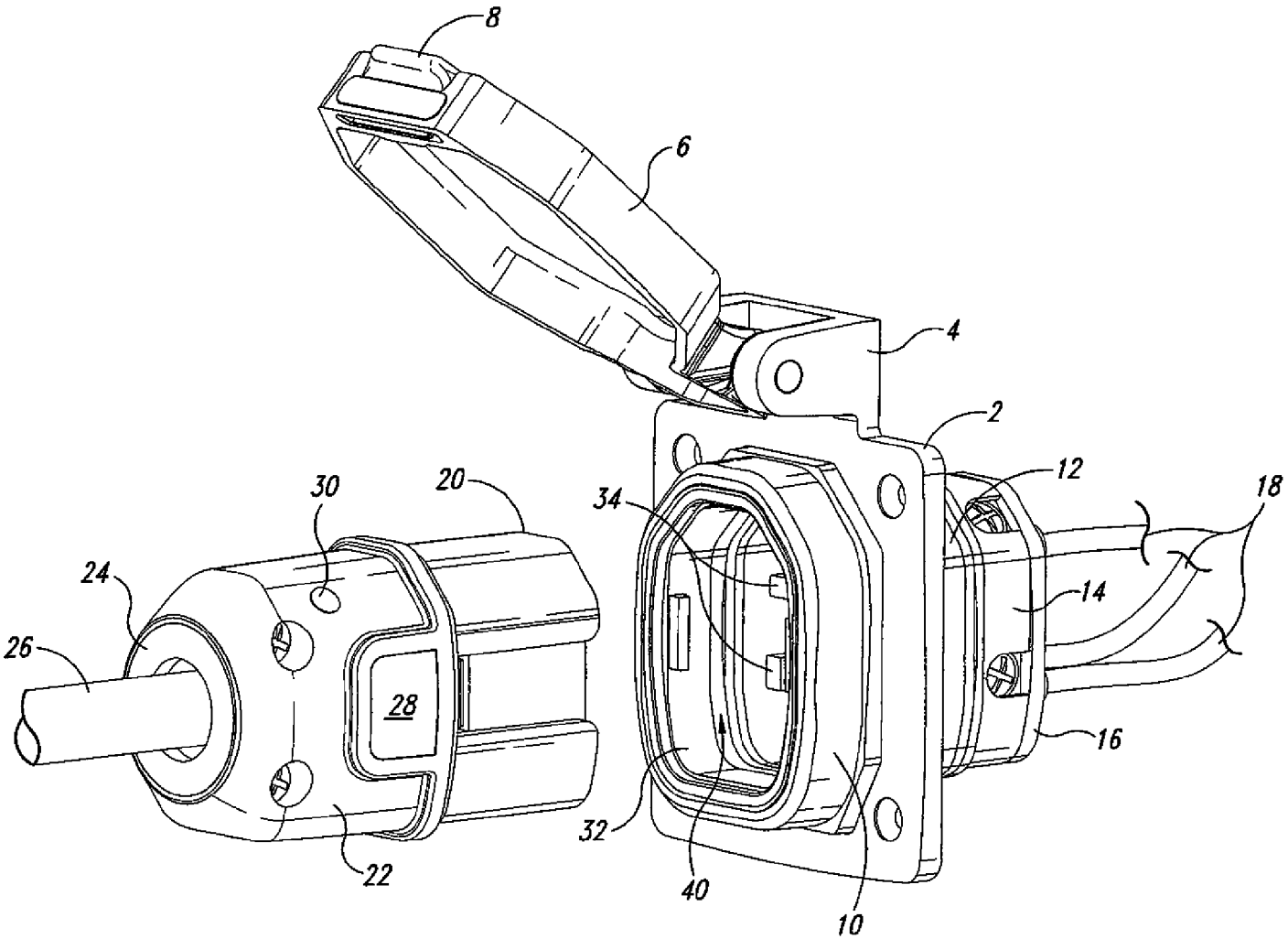
FIG. 1 is an isometric view of the inventive interconnect device.

As seen in FIG. 1, the unit fixed to the vehicle or structure includes a mounting plate 2 for securement to a wall including an outwardly extending hinge element 4 to which is mounted a weather cover 6 including a latch 8. Secured to the mounting plate is front flange 10, a rear flange 12, a receptacle base 14 and a receptacle cover 16 through which extend a plurality of wires 18. Likewise seen in this view is the connector receptacle 20, the housing 22, the cap 24 and input wire 26. Likewise seen in this view are a release button 28 and an LED 30.

The connector receptacle 20 is received within the opening 32 surrounded by the front flange 10. Further seen in this view are the male connector elements 34 which are robust.

Figure 2:
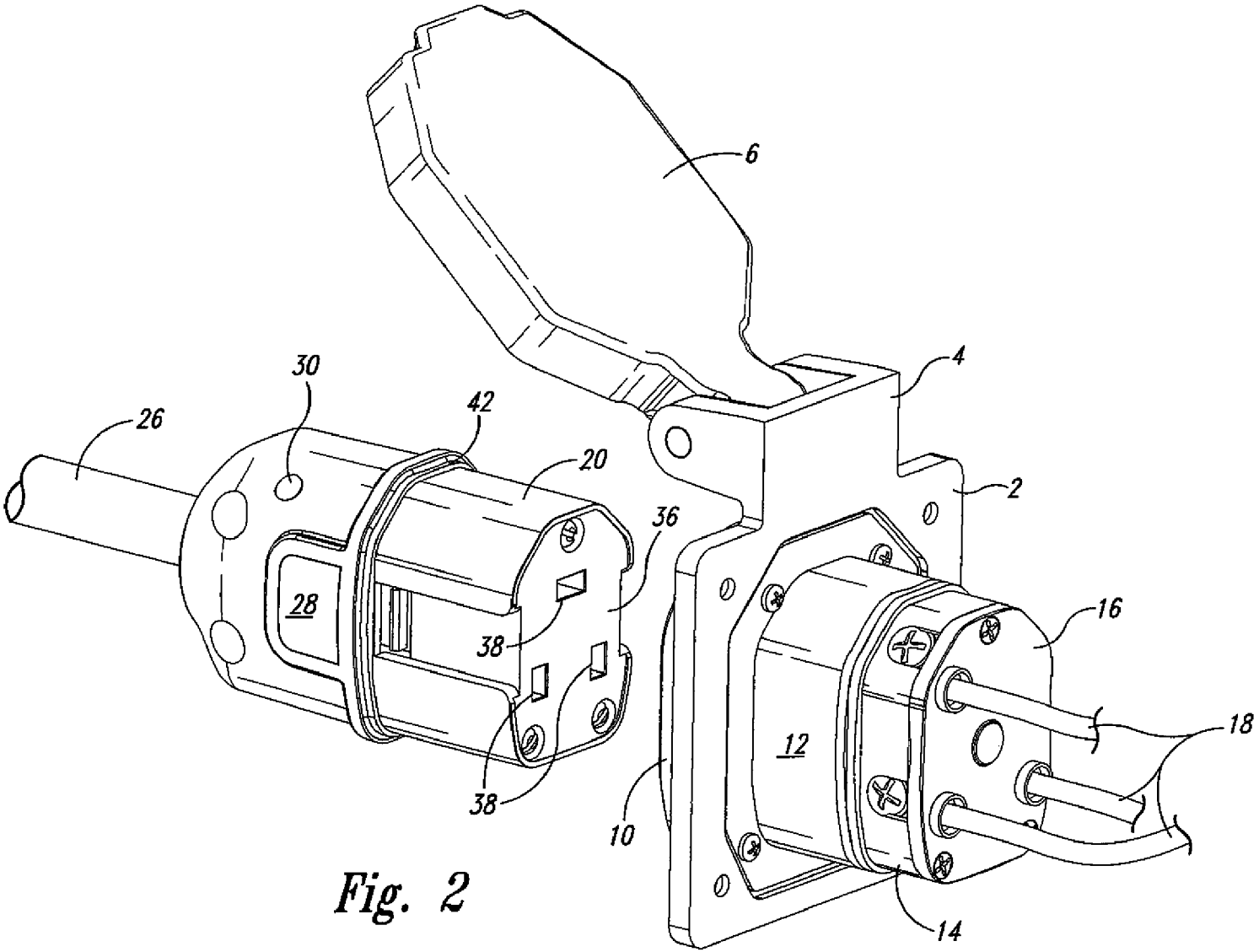
FIG. 2 is an isometric view of the interconnect device looking in the opposite direction from FIG. 1.

Referring now to FIG. 2, similar parts are identified with the identical number as in FIG. 1 and it is further to be seen that within the connector receptacle 20 is the actual connector 36 having openings 38 to receive male connector members 34.

Further to be seen in FIGS. 1 and 2 are sealing gasket members 40 and 42 which are engaged when the receptacle is in the closed position preventing the influx of any liquid. It is to be noted that opening 32 and receptacle 20 are asymmetrical preventing an unaligned connection.

Figure 3:
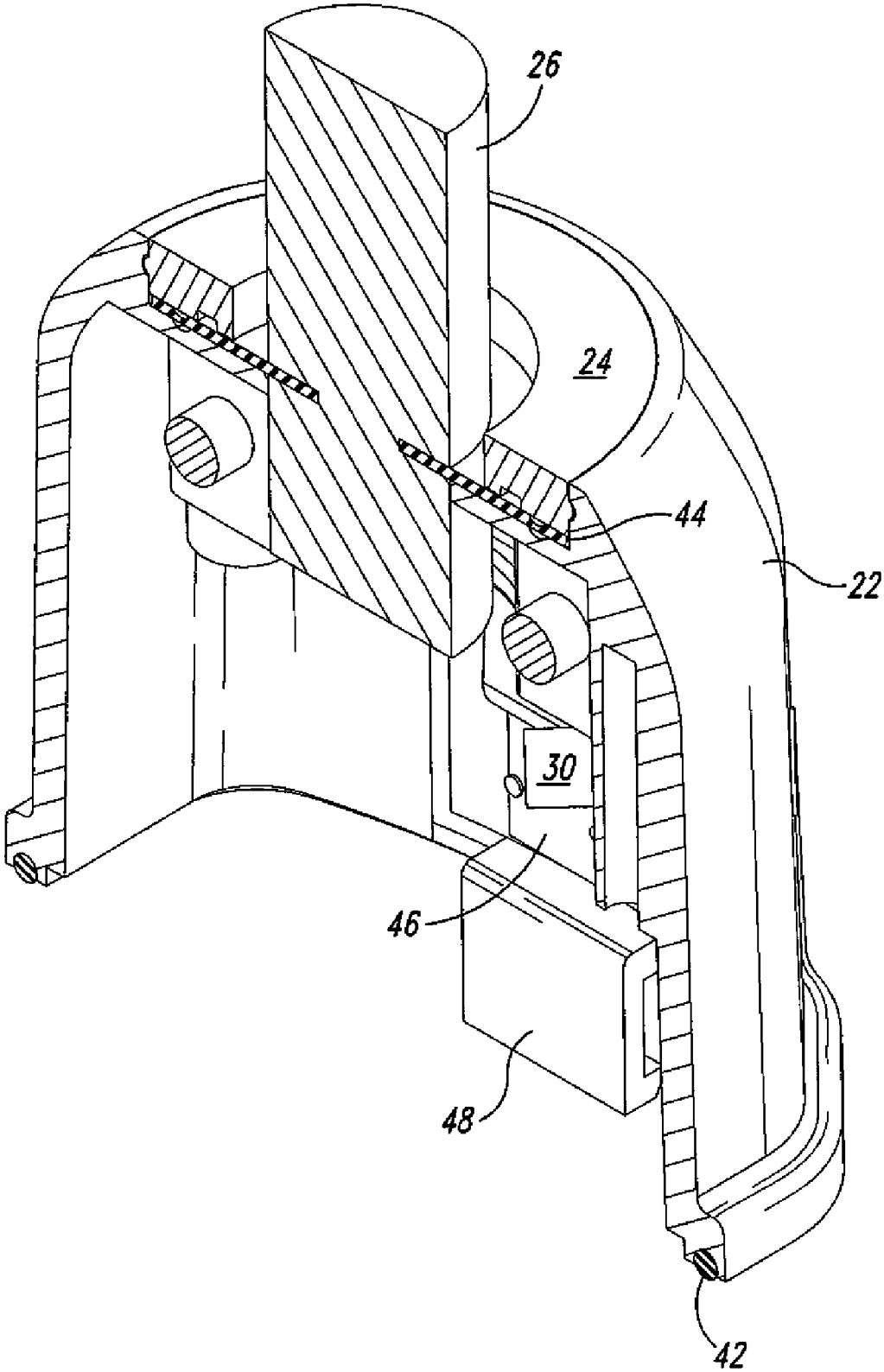
FIG. 3 is a sectional view through the housing for the female element.

As seen in FIG. 3, in addition to the cap 24 on the housing 22, there is a seal 44 which surrounds the input wire 26. Also seen in this view is a spring 46 which urges the button 28 (not shown) outwardly and the button 28 is integral with the snap fastener element 48.

Figure 4:
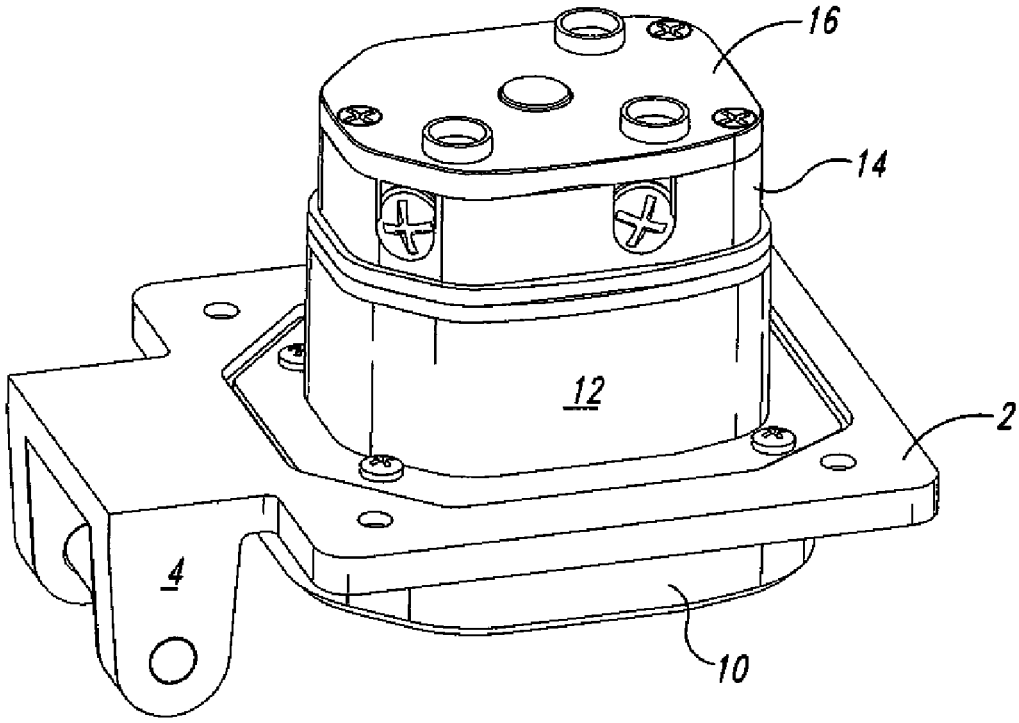
FIGS. 4 and 5 are isometric views of the receptacle base and housing therefor.
Figure 5:
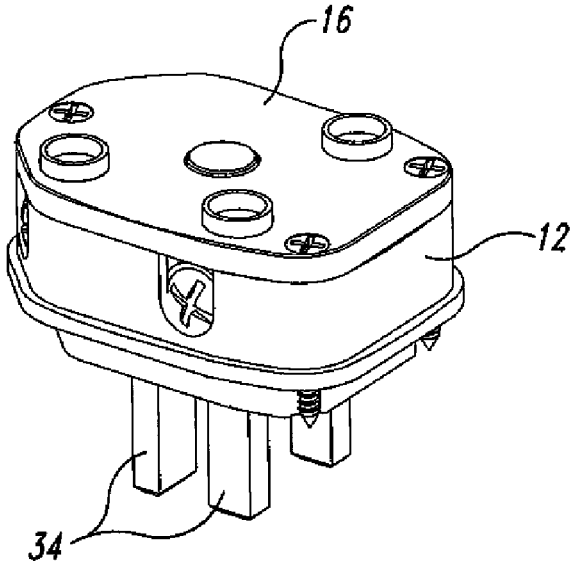

FIGS. 4 and 5 more clearly illustrate the components of the receptacle.

Figure 6:
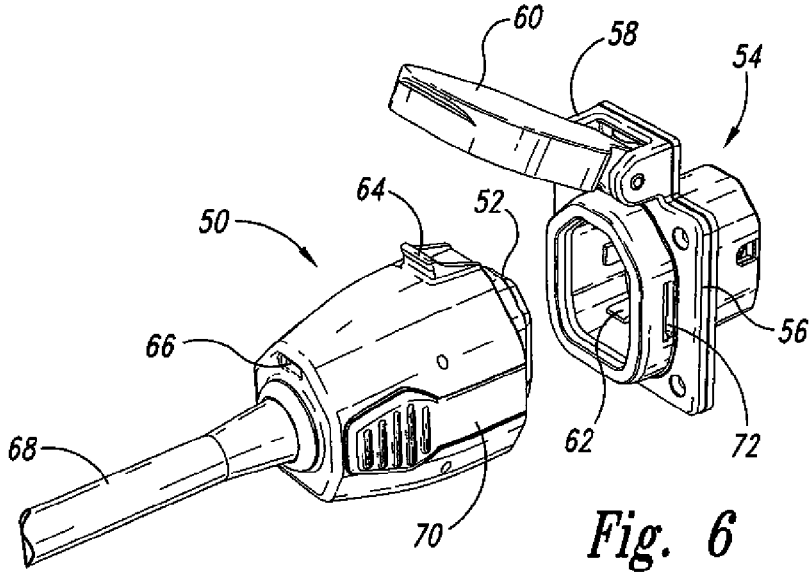
FIGS. 6-8 display interconnect and fasten process of the inventive interconnect device.
Figure 7:
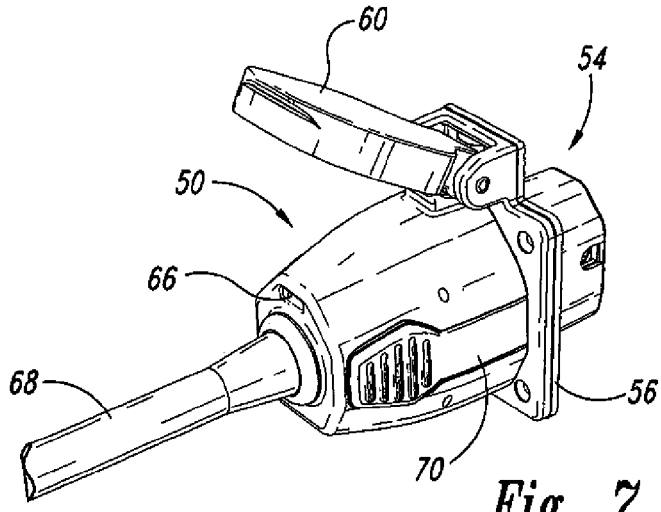
Figure 8:
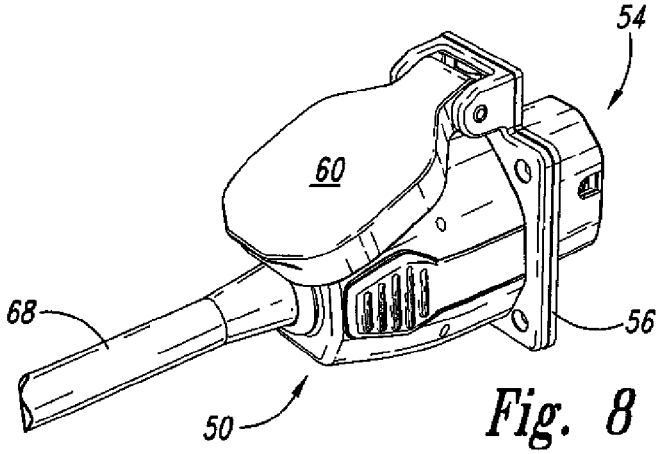

Reference is now had to FIGS. 6-8 depicting a second embodiment of the present invention. As can be seen, a male member, generally designated as 50, includes a nose member 52 which is inserted into the opening of the female member 54. The female member 54 is secured to a relatively fixed portion of a vehicle, be it a boat or a motor home, and is secured to an exterior wall thereof (not shown). The female member 54 includes a mounting plate 56 having at the upper portion thereof a hinge member 58 to which is secured a cover member 60 moveable from an open position as shown in FIG. 6 to a locked position, fully locking the male member 50 to the female member 54 and to a fully closed position (not shown). As explained herein above, the female member 54 includes the electric prongs 62. The male member 50, in addition to the outwardly extending hose 52 includes an upwardly projecting tab 64 to interact and lock with cover member 60, detent 66, likewise used to interlock with the cover member 60, an electric cord 68, and a pair of opposing latch members 70 (only one shown). Latch members 70, when the male member 50 and the female member 54 are interconnected engage with opposing, outwardly faced slots 72.

Reference is now had to FIG. 7, wherein the male member 50 has been fully inserted in the female member 54 and the cover 60 is about to be latched. It is to be noted that a U-shaped hinge member 58 having legs 59 includes at its innermost wall or base a leaf spring 74, best seen in FIG. 9, which interacts with a plurality of flats 76 on the axle surrounding member 77.

Figure 9:
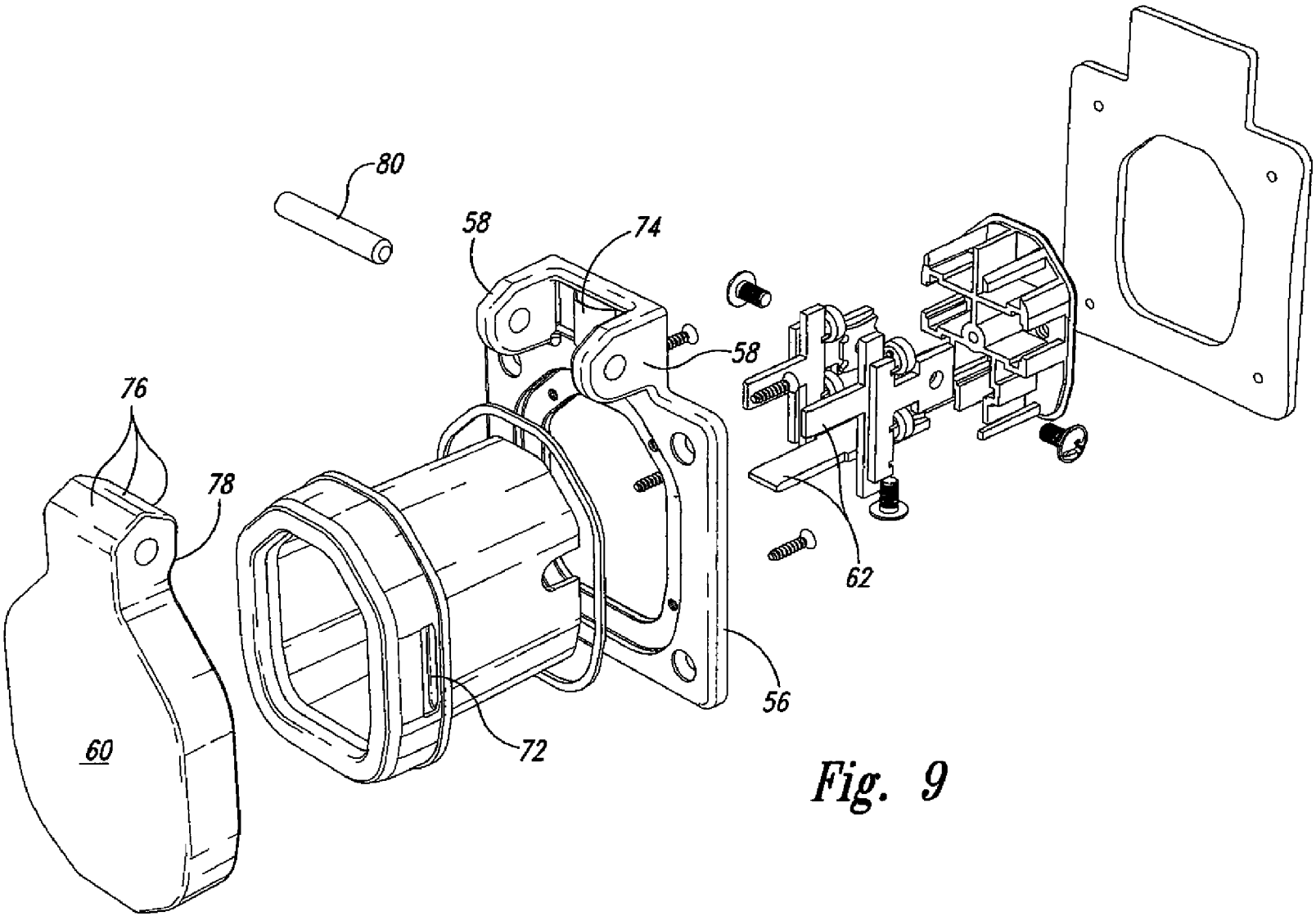
FIG. 9 is an exploded view of the receptacle base.
Figure 10:
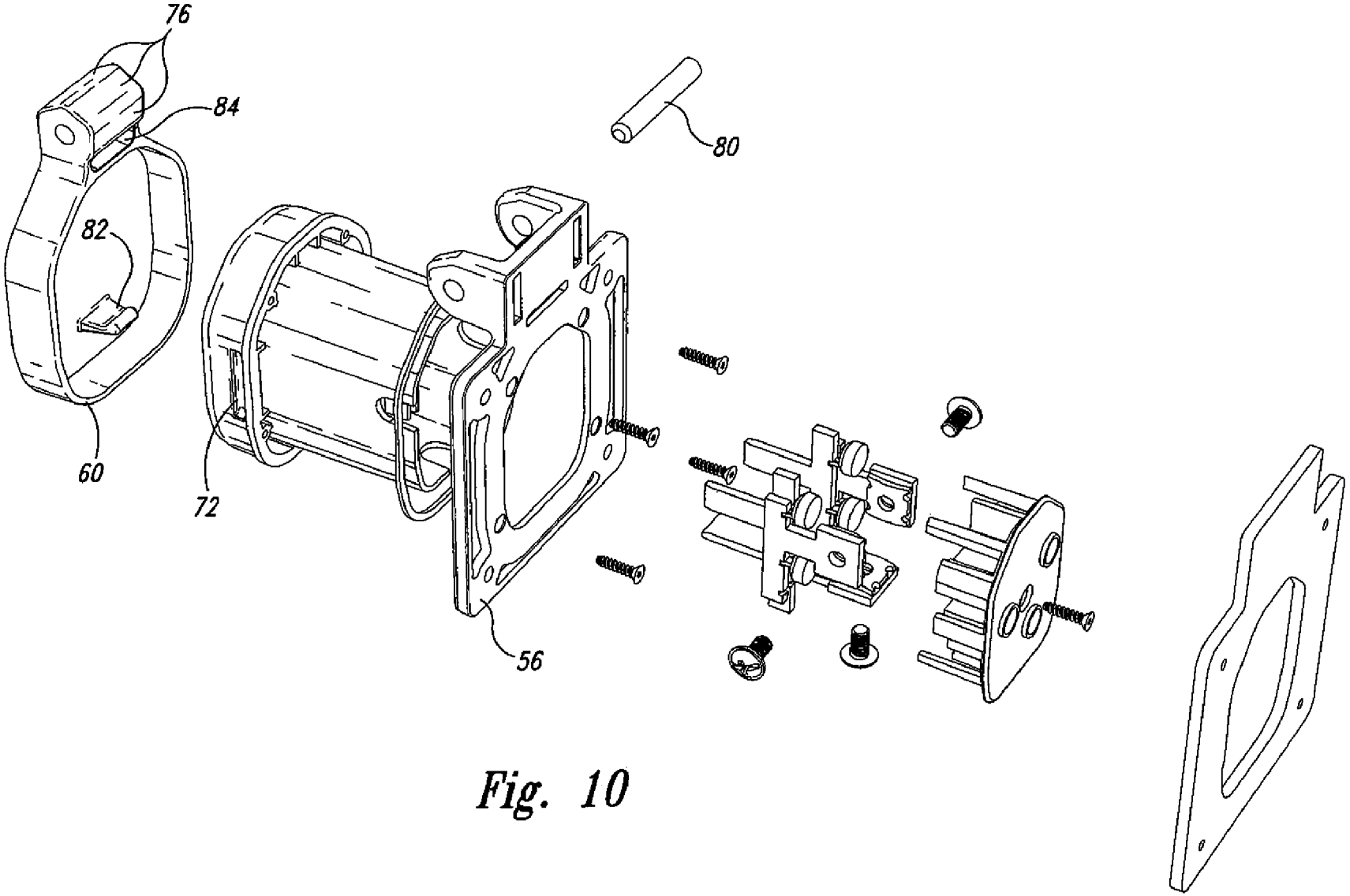
FIG. 10 is a reverse view of the receptacle base.
Figure 11:
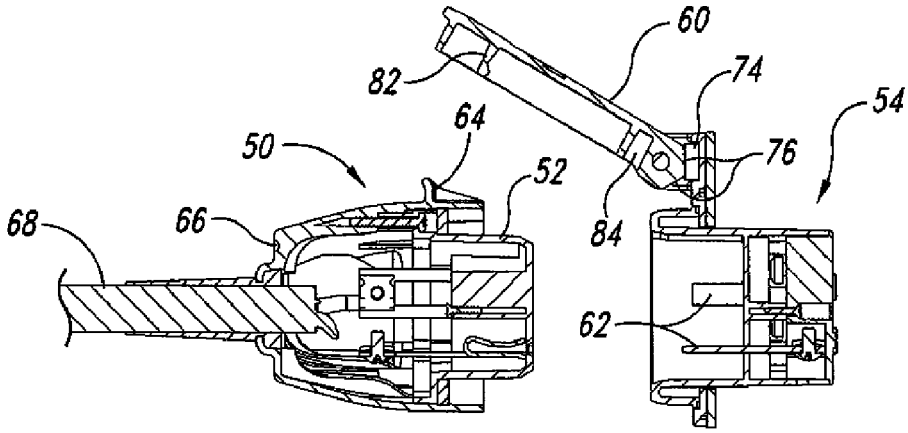
FIGS. 11-13 are sectional views during the interconnect process.
Figure 12:
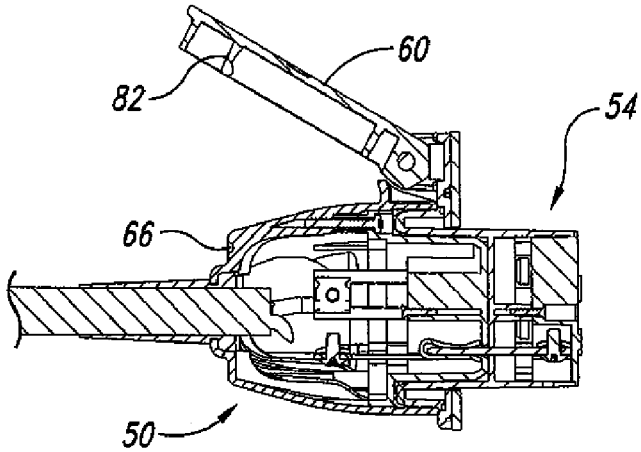
Figure 13:
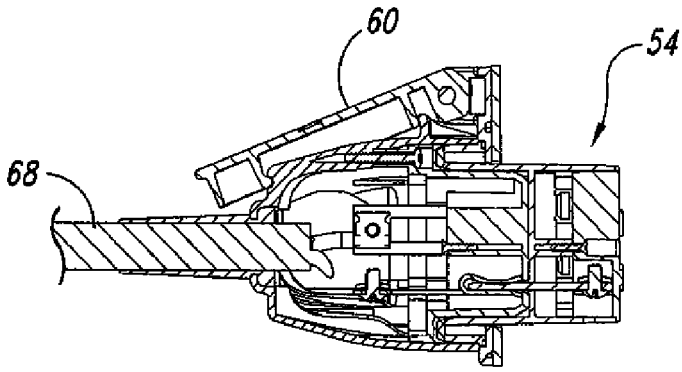

Referring now to FIGS. 9 and 10, reference numeral 70 refers to the interior of the cap, as much better seen in FIG. 10. Numeral 80 is the hinge pin which pivotally interconnects the hinge 4 and the cap 60. Numeral 82 refers to a latch member which hooks behind the detent 66 and 84 is the opening in the cap 60 to receive the tab 64 on the male unit 50.

As thus can be seen, the present invention provides a safer, more secure power input for motor vehicles and/or boats.

Although a preferred embodiment of the invention has been disclosed for purposes of illustration, it should be understood that various changes, modifications and substitutions may be incorporated in the embodiment without departing from the spirit of the invention which is defined by the claims which follow.

What is claimed is:

1. A weatherproof electrical interconnect comprising non-cylindrical, congruous male and female members, wherein the female member is fixedly secured to a relatively stationary object and includes outwardly projecting electrical prongs located internally of the member, and the transportable male member, including receiving slots to accommodate the prongs, multiple sealing means preventing ingress of weather when the male and female are engaged and dual locking means preventing unintentional disengagement.

2. An electrical interconnect as in claim 1, wherein the female member includes a weatherproof cap which also serves to lock the male member in place when engaged.

3. An electrical interconnect as in claim 2, wherein the cap is hinged and is stable at more than one position of openness.

4. An electrical interconnect as in claim 1, wherein a thermostat is located online to prevent overheating.

5. A weatherproof electrical plug comprising:

a first element fixedly secured to a relatively fixed body and a second mating element selectively removable from the first element;

the first element comprising an irregularly configured outwardly facing opening having outwardly extending electrical prongs protruding from the bottom thereof, an outwardly facing peripheral lip from the bottom thereof supporting a seal, and a hinged cover member;

the second element comprising a nose portion configured to mate with the first element and including slots to accept the prongs, an after portion including an interconnecting power line and a forwardly facing peripheral slot including a seal to mate with the first element lip.

* * * * *